US007236136B2

(12) United States Patent
Noro

(10) Patent No.: US 7,236,136 B2
(45) Date of Patent: Jun. 26, 2007

(54) ANTENNA DEVICE

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 8 days.

(21) Appl. No.: 11/231,826

(22) Filed: Sep. 22, 2005

(65) Prior Publication Data

US 2006/0012533 A1 Jan. 19, 2006

Related U.S. Application Data

(62) Division of application No. 10/785,939, filed on Feb. 26, 2004, now Pat. No. 7,002,523.

(30) Foreign Application Priority Data

Mar. 18, 2003 (JP) ..... P. 2003-073220

(51) Int. Cl.
*H01Q 1/32* (2006.01)
*H01Q 1/12* (2006.01)

(52) U.S. Cl. ..... 343/713; 343/878

(58) Field of Classification Search ..... 343/711, 343/713, 702, 878
See application file for complete search history.

(56) References Cited

U.S. PATENT DOCUMENTS 4,096,481 A * 6/1978 Widmer et al. ..... 343/715
5,583,522 A 12/1996 Radomski et al. ..... 343/715
5,859,617 A 1/1999 Fujikawa ..... 343/702
6,486,841 B1 11/2002 Imahigashi ..... 343/715
6,646,613 B1 11/2003 Cheng ..... 343/721
6,762,727 B2 7/2004 Rochford et al. ..... 343/713
7,004,666 B2 * 2/2006 Kozlovski ..... 403/252
2003/0076270 A1 4/2003 Okamoto ..... 343/713

FOREIGN PATENT DOCUMENTS

JP 10-22718 1/1989

* cited by examiner

*Primary Examiner*—Shih-Chao Chen
(74) *Attorney, Agent, or Firm*—Whitham, Curtis, Christofferson & Cook, PC

(57) ABSTRACT

An antenna device is attached to an outer face of a plate member having a through hole connecting the outer face and inner face of the plate member. A cover defines a space for covering an antenna element. A tubular projection extends from the cover so as to communicate with the space and has a first locking member. The projection is inserted into the through hole from the outside to the inside of the plate member in a first direction. A cap member has a second locking member and is adapted to be fitted with the projection from the inside of the plate member such that the second locking member is engaged with the first locking member to lock the cap member in contact with the inner face of the plate member.

8 Claims, 7 Drawing Sheets

ANTENNA DEVICE

RELATED APPLICATION

This application is a divisional of U.S. patent application Ser. No. 10/785,939, filed Feb. 26, 2004, now U.S. Pat. No. 7,002,523, which is incorporated herein by reference.

BACKGROUND OF THE INVENTION

1. Field of the Invention

The present invention relates to an improvement in a mounting structure of an antenna device with respect to a roof of an automobile, for example.

2. Description of the Related Art

An on-vehicle antenna device can be installed by mounting an antenna module to a desired position of a vehicle body, for example, a roof or a neighboring place. A helical antenna element is an omni-directional antenna element, and suitable for receiving various signals such as satellite radio broadcasting signals, broadcasting global positioning system (GPS) signals, cellular telephone signals, etc.

The related art is Japanese Patent Publication No. JP-A-10-22718.

In the above described on-vehicle antenna device, in order to remove an output of the antenna element, it is necessary to draw a lead cable into the vehicle and connect it to a receiving apparatus or the like. For this purpose, a hollow base projection is integrally provided on a bottom cover which contains the antenna element. This base projection is inserted into an opening formed in the roof so that the lead cable can be drawn into the vehicle by way of the base projection.

As in the conventional mounting structure described above, it is known that the above described base projection is in a form of a bolt which is integral with the bottom cover, and this bolt is fixed to the roof by tightening it with nuts by way of a washer. In this case, it is necessary to insert the base projection of the bottom cover into the opening formed in the roof from the outside of the vehicle, and to tighten it with nuts by way of the washer from the inside of the vehicle room.

According to such conventional mounting structure, it is necessary to contemporaneously insert the base projection into the opening formed in the roof, and tighten the nuts from the inside of the vehicle room. Therefore, the mounting work has become cumbersome, not only because at least two workers are required, but because a number of steps are required for the mounting work.

SUMMARY OF THE INVENTION

The present invention proposes in view of the aforementioned problems of the prior art, and an object of the present invention, is to provide an antenna device having a novel mounting structure which enables the antenna device to be easily mounted to a roof of an automobile even by one person, and can maintain the antenna device in a highly reliable state after mounted.

In order to attain the above described object, there is provided, according to the invention, an antenna device comprising an antenna element, and a bottom cover and a top cover which cover the antenna element, characterized in that the aforesaid bottom cover includes a base projection to be inserted into an opening formed in a mounting part, a washer having an elastic force being fitted over this base projection, and that the aforesaid washer comes into contact with an inner face of the mounting part thereby enabling the antenna device to be mounted and fixed.

In the antenna device according to the invention, the washer having the elastic force is employed, and therefore, when the washer is filled over the base projection, for example, is pushed into the opening formed in the mounting part, the washer will retake its original shape by the elastic force after the insertion, and will be brought into contact with the inner face of the mounting part, thereby allowing the antenna device to be mounted and fixed. Such mounting work can be done by one person, and simply pushing it from the outside of the vehicle room would be sufficient.

DESCRIPTION OF THE PREFERRED EMBODIMENTS

Now, the antenna device according to the invention will be described in detail referring to the attached drawings.

Figure 1:
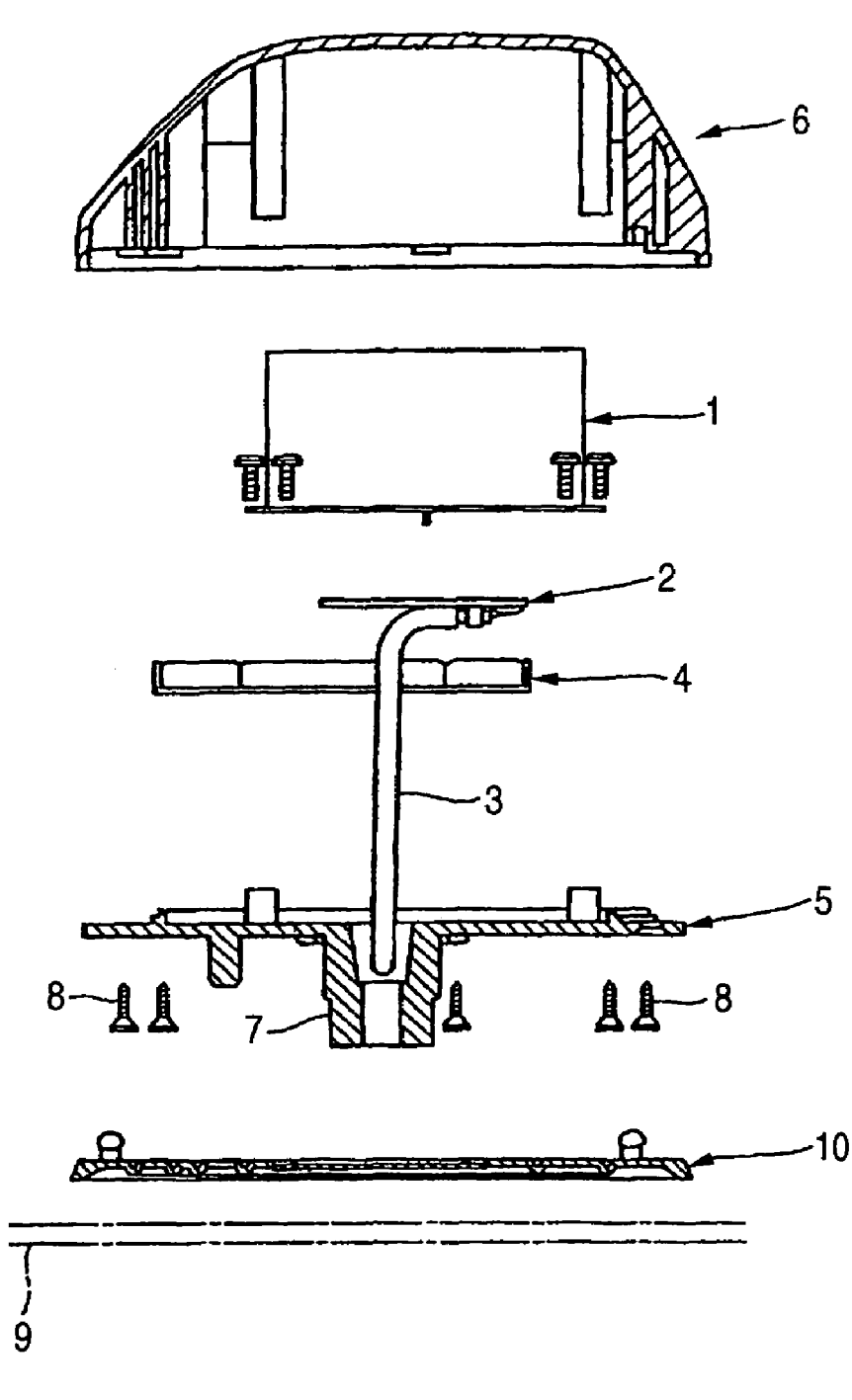
FIG. 1 is a side view showing, in an exploded manner, an antenna device to which the invention is applied.

FIG. 1 is a view showing the antenna device to which the invention is applied, in an exploded manner. This antenna device includes an antenna element 1, a printed board 2 and a lead cable 3 for attaining connections between this antenna element 1 and exterior appliances, a shield case 4 which contains and shields electronic components such as a low noise amplifying circuit mounted on the printed board at a bottom face side of the antenna element 1, and a bottom cover 5 and a top cover 6 which covers the antenna element 1, the printed board 2, the shield case 4 and so on.

The above described antenna element 1 has, for example, an omni-directional helical antenna element mounted thereon, and receives various signals such as satellite radio broadcasting signals, global positioning system (GPS) signals, cellular telephone signals, etc. The signals received are introduced to receiving apparatuses or the like inside the vehicle by way of the above described printed board 2 and the lead cable 3.

The above described bottom cover 5 is provided with a base projection 7 in a substantially cylindrical shape projected downward. The above described lead cable 3 is passed through this base projection 7 to be drawn into the vehicle. Moreover, this bottom cover 5 is mechanically fixed to the top cover 6 by means of screws 8.

The antenna device which has been assembled is mounted to a desired position (a roof or the like) of an automobile body, for example. The antenna device is mounted in such a manner that the bottom cover 5 may be in contact with a roof 9 of the automobile. On this occasion, a gasket 10 made of rubber is interposed between the bottom cover 5 and the roof 9 of the automobile to prevent intrusion of rainwater or the like.

The antenna device is fixed to the roof 9 by fitting a washer made of plastic over the base projection 7 provided on the bottom cover 5, and by inserting them into an opening formed in the roof A mounting structure of this antenna device to the roof 9 will be described hereunder.

Figure 2:
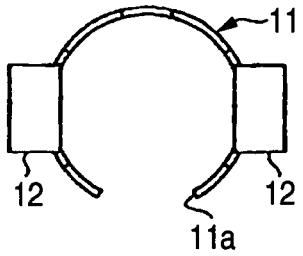
FIG. 2 shows one embodiment of a washer, in which (*a*) is a plan view, (*b*) is a front view, and (*c*) is a side view.
Figure 2:
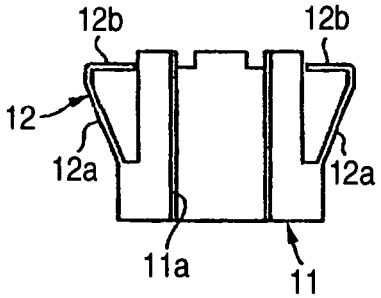
Figure 2:
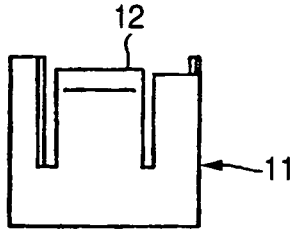

FIGS. 2(*a*), 2(*b*), and 2(*c*) show one embodiment of a washer 11. This washer 11 is an annular member made of metal, and provided with a cut-out 11*a* in its one part and locking claws 12 at two right and left positions. Each of the locking claws 12 has an elastic portion 12*a* which is inclined so as to outwardly spread and a locking piece 12*b* which is folded inwardly. The locking claws 12 can be pushed inwardly against an elastic force, and will be recovered to their original shape by the elastic force, by releasing the push-in force.

Figure 3:
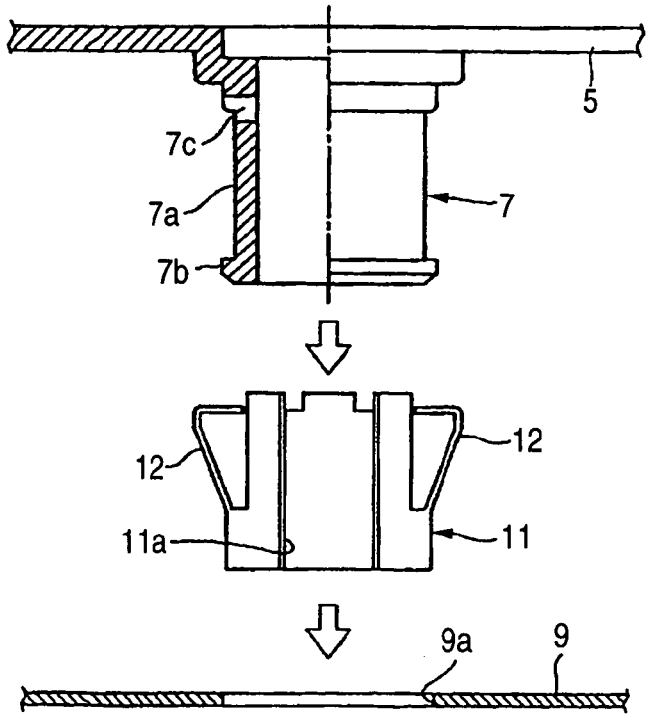
FIG. 3 is a view showing a step of mounting a bottom cover and the washer to a roof.

On the other hand, the base projection 7 of the bottom cover 5 includes, as shown in FIG. 3, a washer engaging portion 7*a* which has substantially the same outer diameter as an inner diameter of the above described washer 11, a locking rib 7*b* which is formed so as to project from an outer peripheral face of a tip end part of the washer engaging portion 7*a* thereby to support a bottom face of the washer 11, and locking holes 7*c* into which the locking pieces 12*b* of the locking claws 12 of the washer 11 are adapted to be inserted.

When the base projection 7 of the bottom cover 5 is pushed into the washer 11, the washer 11 will be spread since the cut-out 11*a* has been formed, and the washer 11 will be engaged with the washer engaging portion 7*a* of the base projection 7. When the base projection 7 in this state is further pushed into an opening 9*a* formed in the roof 9, the locking claws 12 of the washer 11 will be pushed inwardly against the elastic force, and the washer 11 in a state fitted over the base projection 7 will be inserted into the vehicle room through the opening 9*a* formed in the roof 9.

Figure 4:
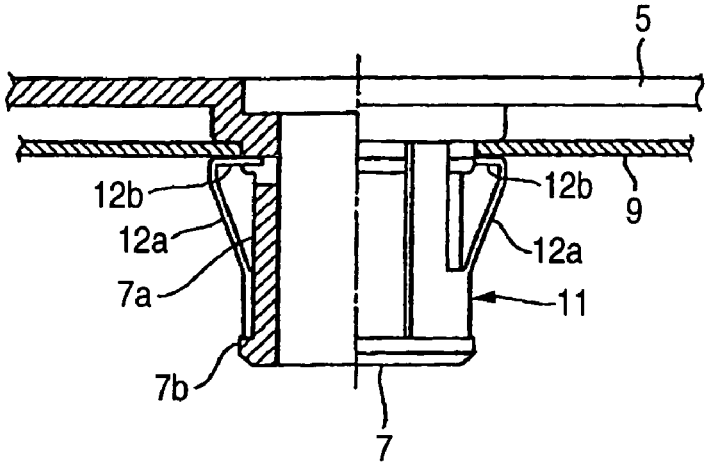
FIG. 4 is a view partly cut away showing a state in which the bottom cover and the washer have been mounted to the roof.

After the washer 11 has passed through the opening 9*a* formed in the roof 9, a pressure which has been exerted on the locking claws 12 will be released, and the locking claws 12 will be recovered to their original shape by the elastic force so as to project outwardly, as shown in FIG. 4. As the results, the locking pieces 12*b* of the washer 11 will be brought into contact with an inner face of the roof 9, and the locking rib 7*b* provided on the base projection 7 of the bottom cover 5 will come into contact with the bottom face of the washer 11 thereby allowing the antenna device to be mounted and fixed.

Operations as described above can be performed by one worker in the outside of the vehicle room, for example. Moreover, complicated works such as fixing with screws are unnecessary, and the mounting work is made easier by the simple push-in operation.

In order to prevent displacement in the mounting direct due to the circular shape of the washer 11 and base projection 7, a locator pin for preventing rotation, for example, may be uprightly provided on the bottom cover 5, and by inserting the locator pin into a hole formed in the roof 9, it would be possible to determine the mounting direction reliably and accurately.

Figure 5:
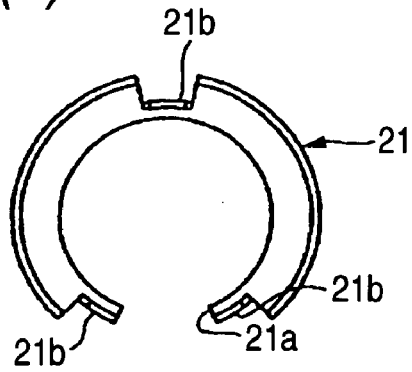
FIG. 5 shows another embodiment of the washer, in which (*a*) is a plan view, and (*b*) is a front view.
Figure 5:
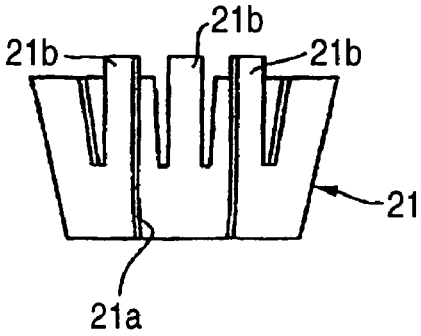

FIGS. 5(*a*), 5(*b*), and 5(*c*) show an embodiment of a washer 21 having a different shape. This washer 21 has also an annular shape. However, the washer 21 has an inverted frustum shape which is inclined so as to be gradually enlarged in diameter upwardly, and is also provided with a cut-out 21*a*. There are further provided a plurality of bottom cover contact pieces 21*b* which are slightly projected upwardly, at three positions spaced at an equal angle, in this embodiment.

Figure 6:
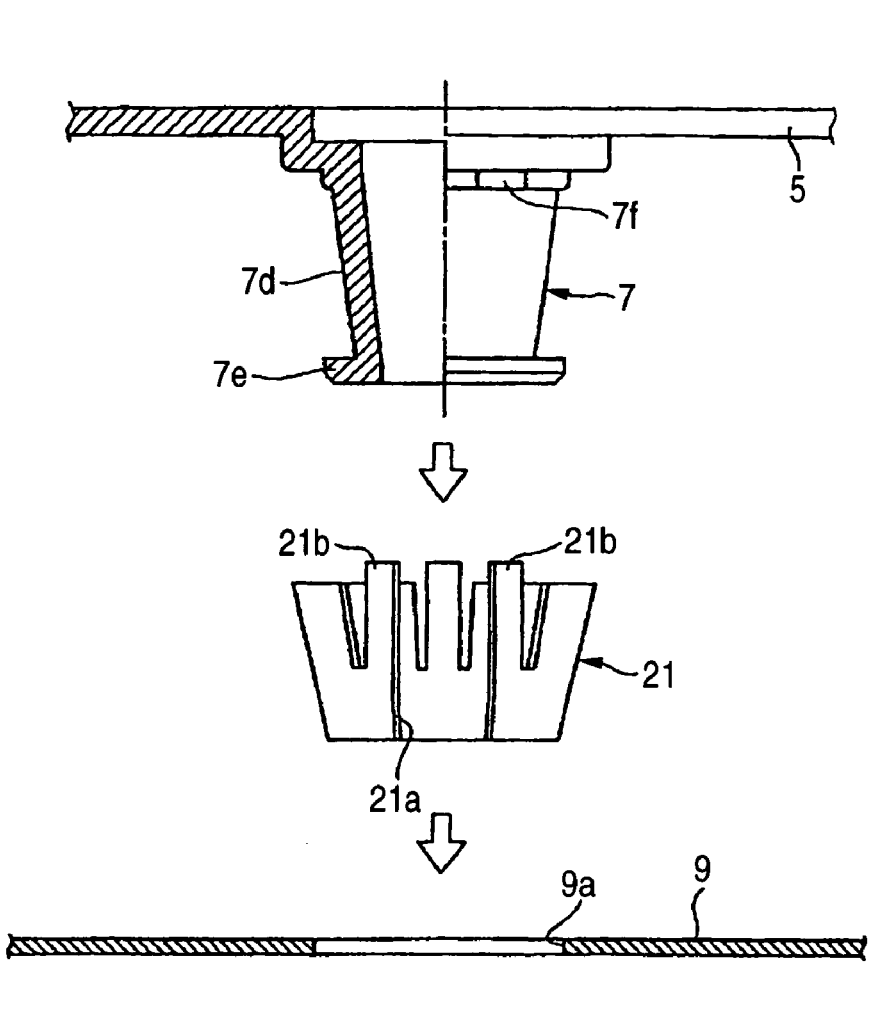
FIG. 6 is a view showing a step of mounting the bottom cover and the washer to the roof.

On the other hand, the base projection 7 of the bottom cover 5 includes, as shown in FIG. 6, a washer engaging portion 7*d* which has an inverted frustum shape in correspondence with the shape of the above described washer 21, a locking rib 7*e* which is formed so as to project from an outer peripheral face of a tip end part of the washer engaging portion 7*d* to support a bottom face of the washer 21, and locking holes 7*f* into which the bottom cover contact pieces 21*b* of the washer 21 are adapted to be inserted.

When the base projection 7 of the bottom cover 5 is pushed into the washer 21, the washer 21 will be spread since the cut-out 21*a* has been formed, and the washer 21 will be engaged with the washer engaging portion 7*d* of the base projection 7. When the base projection 7 in this state is further pushed into the opening 9*a* formed in the roof 9, the washer 21 will be reduced in diameter against the elastic force, because the cut-out 21*a* has been formed in the washer 21, and the washer 21 in a state fitted over the base projection 7 will be inserted into the vehicle room through the opening 9*a* formed in the roof 9.

Figure 7:
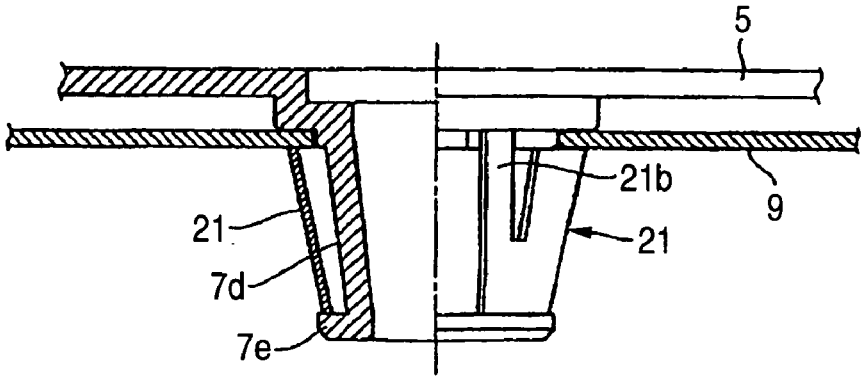
FIG. 7 is a view partly cut away showing a state in which the bottom cover and the washer have been mounted to the roof.

After the washer 21 has passed through the opening 9*a* formed in the roof 9, a pressure exerted on the washer 21 will be released, and the washer 21 will be recovered in shape by the elastic force up to the original diameter, as shown in FIG. 7. As a result, an upper end edge of the washer 21 will be brought into contact with the inner face of the roof 9, and the locking rib 7*e* provided on the base projection 7 of the bottom cover 5 will come into contact with the bottom face of the washer 21 thereby allowing the antenna device to be mounted and fixed.

Figure 8:
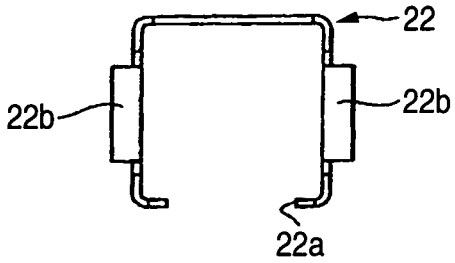
FIG. 8 shows still another embodiment of the washer, in which (*a*) is a plan view, (*b*) is a front view, and (*c*) is a side view.
Figure 8:
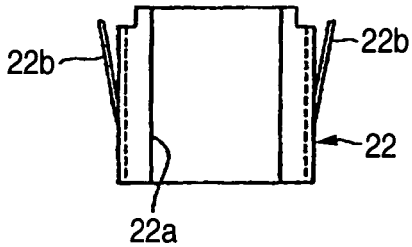
Figure 8:
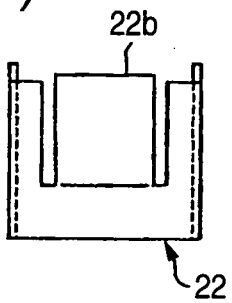

FIGS. 8(*a*), 8(*b*), and 8(*c*) show an embodiment of a washer 22 having a further different shape. Different from the two foregoing embodiments, this washer 22 has an angular cylindrical shape. There is formed a cut-out 22*a* in its one part in the same manner, but the locking claws 22*b* provided at the two right and left positions have only elastic portions which are inclined so as to simply spread outwardly. This is because the washer 22 having the angular cylindrical shape will not rotate with respect to the base projection 7 of the bottom cover 5, and so, it would be unnecessary to lock the locking pieces with respect to the base projection 7.

Figure 9:
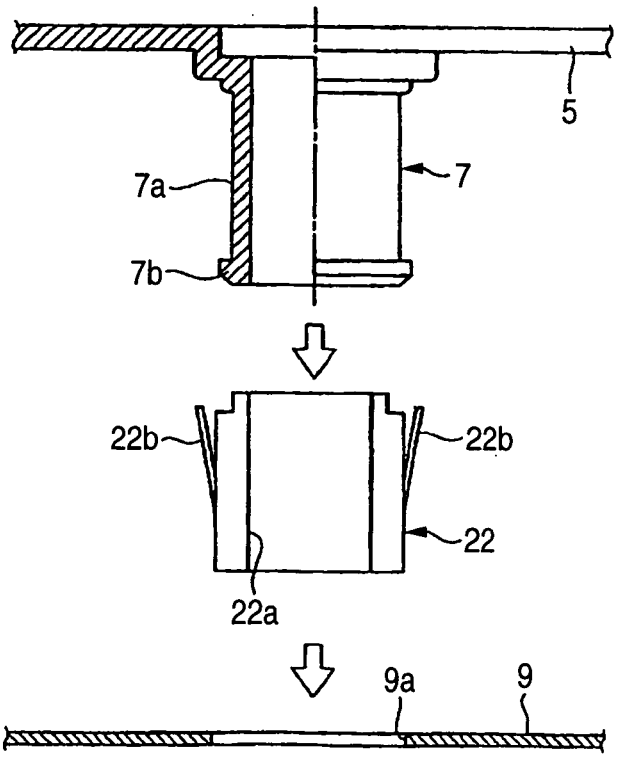
FIG. 9 is a view showing a step of mounting the bottom cover and the washer to the roof.

When the base projection 7 of the bottom cover 5 is pushed into the washer 22 as shown in FIG. 9, the washer 22 will be spread since the cut-out 22*a* has been formed, and the washer 22 will be engaged with the washer engaging portion 7*a* of the base projection 7. When the base projection 7 in this state is further pushed into the opening 9*a* formed in the roof 9, the locking claws 22*b* of the washer 22 will be pushed inwardly against the elastic force, and the washer 22 in a state fitted over the base projection 7 will be inserted into the vehicle room through the opening 9*a* formed in the roof 9.

Figure 10:
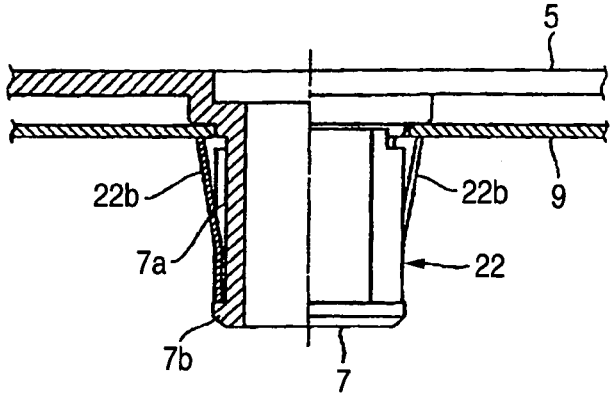
FIG. 10 is a view partly cut away showing a state in which the bottom cover and the washer have been mounted to the roof.

After the washer 22 has passed through the opening 9*a* formed in the roof 9, a pressure exerted on the locking claws 22*b* will be released, and the locking claws 22*b* will be recovered to their original shape by the elastic force so as to project outwardly, as shown in FIG. 10. As the results, the locking claws 22*b* of the washer 22 will be brought into contact with the inner face of the roof 9, and the locking rib 7*b* provided on the base projection 7 of the bottom cover 5 will come into contact with the bottom face of the washer 22 thereby allowing the antenna device to be mounted and fixed.

Figure 11:
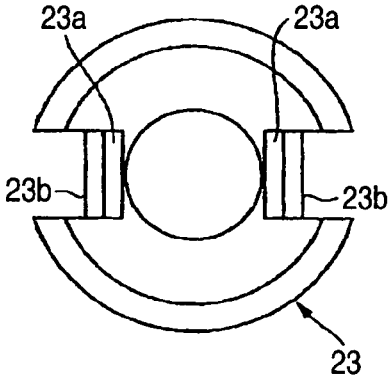
FIG. 11 shows still another embodiment of the washer, in which (*a*) is a plan view, (*b*) is a front view, and (*c*) is a side view.
Figure 11:
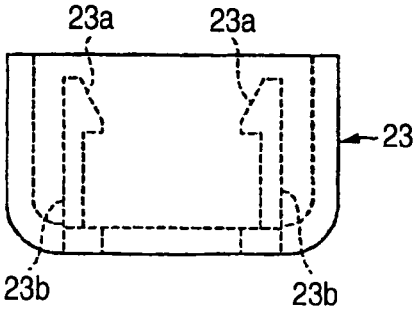
Figure 11:
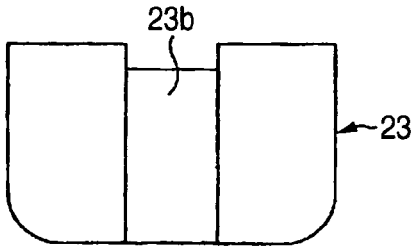
Figure 12:
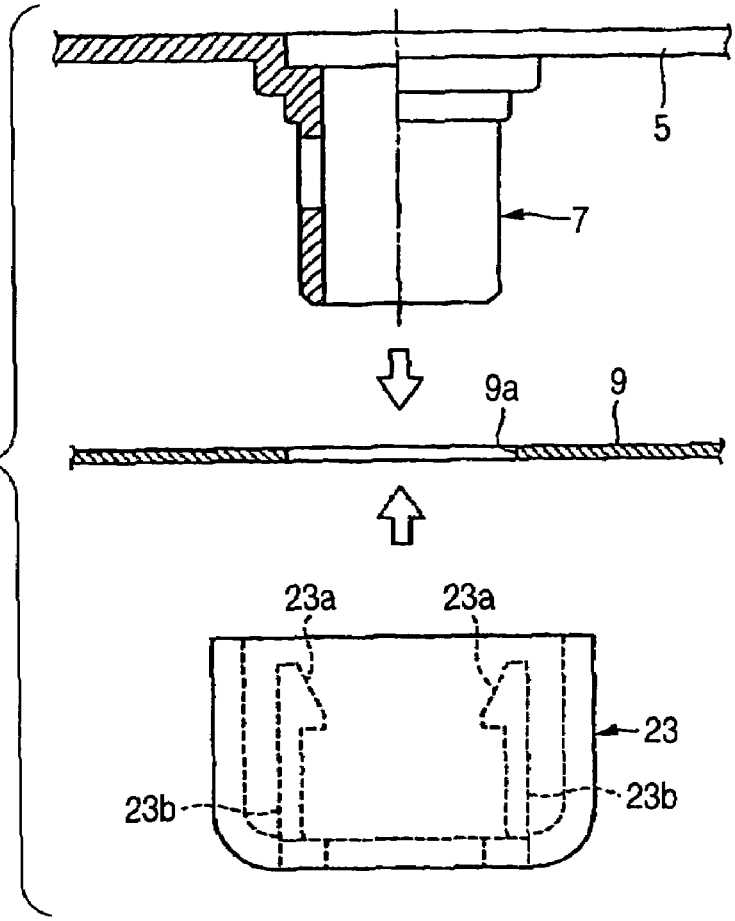
FIG. 12 is a view showing a step of mounting the bottom cover and the washer to the roof.

FIGS. 11(*a*), 11(*b*), and 11(*c*) show an embodiment of a washer 23 which is different from the foregoing embodiments, and adapted to be mounted from the inside of the vehicle room. The washer 23 in this embodiment has a so-called cap-like shape. A pair of locking portions 23*b* having respective locking pieces 23*a* which are inwardly directed are formed uprightly in this washer 23.

Figure 13:
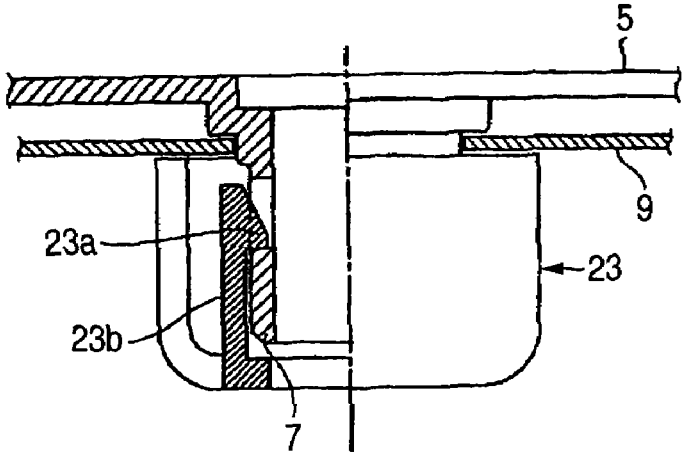
FIG. 13 is a view partly cut away showing a state in which the bottom cover and the washer have been mounted to the roof.

The base projection 7 provided on the bottom cover 5 in this embodiment is inserted into the opening 9*a* formed in the roof 9 from the outside of the vehicle room, and the washer 23 is mounted to the inserted base projection 7 from the inside of the vehicle room. After the washer 23 has been mourned, the locking pieces 23*a* of the locking portions 23*b* are locked to the base projection 7 and mechanically fastened, as shown in FIG. 13. Then, the washer 23 will be brought into contact with the inner face of the roof 9, thereby allowing the antenna device to be mourned and fixed.

Although two persons are required to conduct the work in this embodiment, the work involved is simple, and the mounted state is highly reliable.

As apparent from the foregoing description, according to the antenna device of the invention, it is possible to provide an antenna device which can be easily mounted to a roof of an automobile even by one person, and can be maintained in a highly reliable state after mounted.

What is claimed is:

1. An antenna device attached on an outer face of a plate member having a through hole connecting the outer face and an inner face of the plate member, the antenna device comprising:

an antenna element;

a cover, defining a space for covering the antenna element;

a tubular projection, extended from the cover so as to communicate with the space, comprising a first locking member, the projection inserted into the through hole from the outside to the inside of the plate member in a first direction; and a cap member, comprising a second locking member, and adapted to be fined with the projection from the inside of the plate member such that the second locking member is engaged with the first locking member to lock the cap member in contact with the inner face of the plate member.

2. The antenna device of claim 1, wherein the first locking member comprises at least one detent in a side of said tubular projection at a fixed location along its longitudinal axis, and wherein said second locking member comprises at least one inwardly projecting locking piece which fits within said at least one detent and secures said cap member at said fixed location on said tubular projection.

3. The antenna device of claim 2, wherein said cap member further comprises a base and top, wherein said second locking member extends a distance up from said base to engage said at least one detent and wherein said top of said cap member extends beyond said second locking member and contacts the inner face of the plate member.

4. The antenna device as set forth in claim 1, wherein the second locking member is engaged with the first locking member so as to prevent the cap member from moving in the first direction.

5. The antenna device as set forth in claim 1, wherein the second locking member includes a locking piece extending in a direction perpendicular to the first direction; and the locking piece is engaged with the first locking member so as to prevent the cap member from moving in the first direction.

6. The antenna device as set forth in claim 1, wherein the first locking member is engaged with the second member so as to prevent the cover from moving in a second direction opposite to the first direction.

7. The antenna device as set forth in claim 1, wherein the cap member defines a chamber; and the second locking member is provided within the chamber.

8. A method of attaching an outer face of a plate member having a through hole connecting an outer face and an inner face of the plate member, the method comprising steps of:

providing an antenna device comprising:

an antenna element;

a cover, defining a space for covering the antenna element; and a tubular projection, extended from the cover so as to communicate with the space, comprising a first locking member;

providing a cap member comprising a second locking member at the inside of the plate member;

inserting the projection, into the through hole from the outside to the inside of the plate member in a first direction; and fitting the cap member to the projection from the inside of the plate member, such that the second locking member is engaged with the first locking member to lock the cap member in contact with the inner face of the plate member.

* * * * *